United States Patent [19]

Collin

[11] Patent Number: 4,678,237

[45] Date of Patent: Jul. 7, 1987

[54] CUTTER INSERTS FOR PICKS

[75] Inventor: William D. Collin, Sandton, South Africa

[73] Assignee: Huddy Diamond Crown Setting Company (Proprietary) Limited, Johannesburg, South Africa

[21] Appl. No.: 520,594

[22] Filed: Aug. 5, 1983

[30] Foreign Application Priority Data

Aug. 6, 1982 [ZA] South Africa ..... 82/5690

[51] Int. Cl.[4] ..... E21C 35/18; E21B 10/46

[52] U.S. Cl. ..... 299/79; 175/410

[58] Field of Search ..... 299/91, 79; 175/410, 175/329

[56] References Cited

U.S. PATENT DOCUMENTS

| | | | |
|---|---|---|---|
| 3,342,532 | 3/1967 | Krekeler | 175/410 |
| 3,807,804 | 5/1974 | Kniff | 299/91 |
| 3,841,709 | 2/1974 | Kniff | 299/91 |
| 4,140,189 | 4/1979 | Garner | 175/410 |
| 4,149,753 | 3/1979 | Stoltz et al. | 299/91 |
| 4,200,159 | 7/1980 | Peschel et al. | 175/410 |
| 4,303,136 | 6/1981 | Ball | 175/410 |
| 4,323,130 | 4/1982 | Dennis | 175/410 |
| 4,505,342 | 3/1985 | Barr et al. | 175/410 X |
| 4,512,425 | 4/1985 | Brock | 175/410 X |
| 4,512,426 | 4/1985 | Bidegaray | 175/410 X |

FOREIGN PATENT DOCUMENTS

| | | | |
|---|---|---|---|
| 1248591 | 11/1967 | Fed. Rep. of Germany | 299/91 |
| 2849711 | 2/1979 | Fed. Rep. of Germany | 299/91 |
| 502448 | 9/1951 | France | 299/91 |
| 2083855 | 3/1982 | United Kingdom | 299/91 |

OTHER PUBLICATIONS

Atkins, Brian C., "Drilling Application Successes using STRATAPAX Blank Bits in Mining and Construction", Jan., 1982—General Electric Publication.

*Primary Examiner*—James A. Leppink
*Assistant Examiner*—Michael A. Goodwin
*Attorney, Agent, or Firm*—Lyon & Lyon

[57] ABSTRACT

A stud for use in a mining pick is disclosed which has a tip consisting of a polycrystalline diamond composite and a body having a carrying surface on which the tip is mounted, the carrying surface being inclined to the axis of the body by an angle of between 45° and 65°. In an embodiment of the invention, the stud is received within a pocket and the head of a mining pick, the axis of the pocket in the head axis of the mining pick being substantially coincident, and the mining pick having a shank adapted to be received within the box of a mining machine. The stud may be provided with side extensions adjacent to the composite to protect the material of the mining pick body.

15 Claims, 14 Drawing Figures

CUTTER INSERTS FOR PICKS

Figure 1:
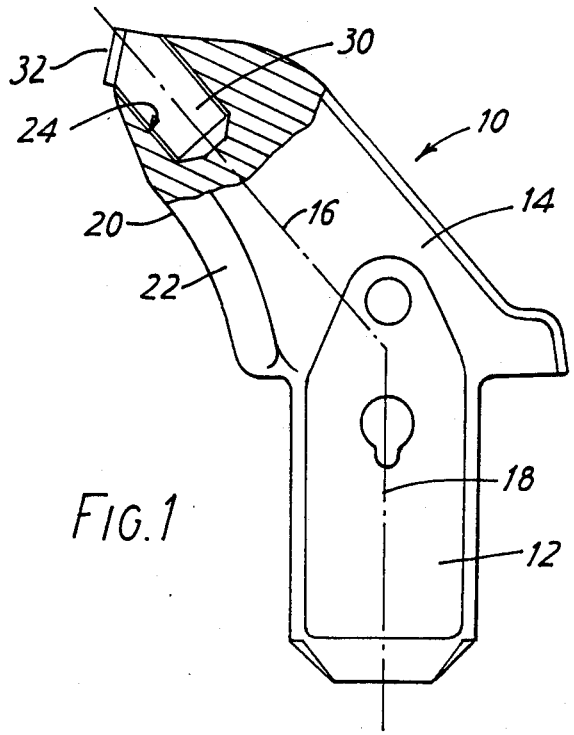

This invention relates to cutter inserts for picks.

Drum shearers and other mining equipment (such as continuous miners) having removable picks or bits (hereinafter called "mining picks") are known. Each such mining pick normally comprises a shank for insertion into a holder or box in the drum of a drum shearer (or a corresponding part of the mining equipment) and a head incorporating a cutting tip. The cutting tip is usually formed on a cutting insert which is a separate hardened member that is received in a pocket formed in the head and there brazed into position.

It is known to provide a cutting tip comprising a working face of polycrystalline diamond carried on a very hard material substrate (comprising a material such as tungsten carbide) which cutting tip is known as a polycrystalline diamond composite hereinafter referred to as "PDC"). The PDC is in turn mounted on a cylindrical body (which also comprises tungsten carbide or similar very hard material) to form a cutter insert. Such a cutting tip is herein referred to as a "stud". Studs are currently being made by General Electric Company under the trade mark "STRATAPAX" and by De Beers Industrial Diamond Division under the trade mark "SYNDRILL".

In known studs the PDC is cylindrical and of small axial length. The axis of the PDC may be coincident with that of the body or it may be inclined at 70 degrees to the axis of the body (as in dthe "Stratapax" 2542 cutter and the "Syndrill" SD-SC Stud cutter).

Such studs have application in various operations including oil drilling and quarrying operations. In the operations in which the above mentioned "Stratapax 2542" cutter has been used, the angle of attack of the stud body is at or substantially at ninety degrees and of course with the extended substrate stud, the angle of attack is the same as the rake angle.

For clarity certain terms (in addition to those elsewhere defined herein) as used herein will now be defined. By the term "angle of attack" is meant the inclination of the axis of the mining pick to the cutting direction of the cutter. By the term "head axis" of the mining pick is meant the notional line central of the width of the pick head joining the midpoint of the head of the pick with the nose of the cutter. It is of course understood that in practice the location of the axis may vary somewhat from the mathematically precise location mentioned above, and the term is to be construed accordingly. By the term "pick blank" is meant a mining pick into which a cutter has yet to be fixed. By the term "rake angle" is meant the angle of the face of the cutter to the direction of translation thereof. When this angle is obtuse, there is "positive rake" and when the angle is acute, there is "negative rake".

The known studs cannot be effectively used with mining picks such as are required in coal mining operations where the angle of attack of the mining pick is positive and at about forty degrees. According to one aspect of the present invention there is provided a stud for use in a mining pick comprising a tip consisting of a polycrystalline diamond composite and having a cutting face and a body having two ends between which extends the a axis, the body comprising a lower portion extending from one end of the body and a carrying surface at the other end of the body on which carrying surface the tip is mounted, in which the carrying surface is inclined to the axis of the body by an angle of between about 45° to 65°. Preferably the face of the composite is inclined to the axis of the body by an angle of between 45° and 65°, preferably between about 50° and 60° and in preferred embodiments at about 52.5° and at about 55°.

According to another aspect of the invention there is provided a mining pick comprising a shank adapted to be received with in a box of a mining machine, the shank having a central axis; and a head extending from the shank, the head having an axis extending from substantially the intersection between the axis of the shank at the place where the head meets the shank to the opposite extremity of the head, a pocket in the head at its end remote from the shank and extending with its axis substantially coincident with the head axis of the mining pick, and the body of a stud as set forth above received within the said pocket.

According to a further aspect of the invention there is provided a pick blank comprising a shank adapted to be received within a box of a mining machine and a head extending therefrom, the head having therein a pocket at its end remote from the shank, which pocket extends with its axis substantially coincident with the axis of the mining pick and which is adapted to receive therein the body of a stud as set forth above.

The stud mentioned above is conveniently provided with side extensions adjacent to the composite to protect the material of the mining pick body. In such a case, the pocket is extended to receive such extensions.

According to another aspect of the invention there is provided a method of mining coal comprising utilising a mining machine (such as a drum shearer, a continuous miner or a blind hole boring machine) incorporating a plurality of mining picks, which picks are as described above.

A number of embodiments of the invention will now be described by way of example with reference to the accompanying drawings.

In the drawings

Figure 2:
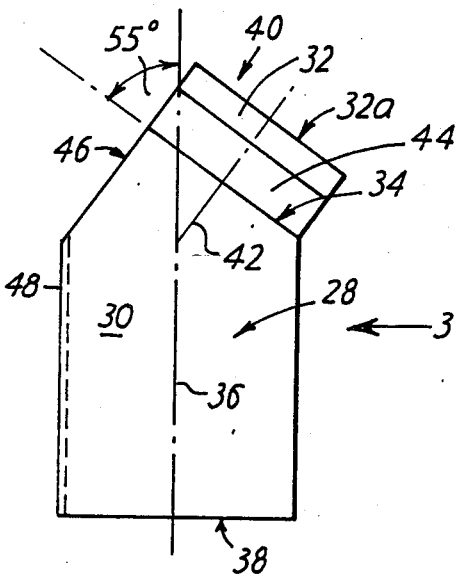
Figure 3:
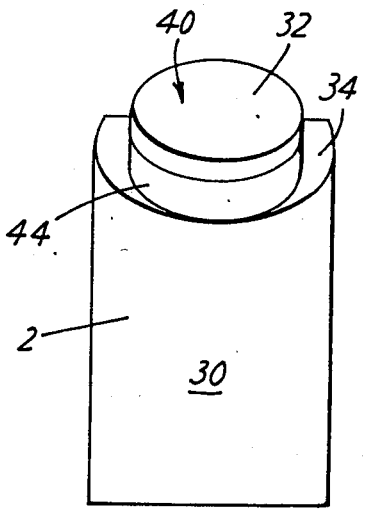

FIG. 1 is a side view partially in section of a mining pick of the invention, FIG. 2 is a side view of a stud of the invention, FIG. 3 is a view of the stud in the direction of arrow 3 in

Figure 4:
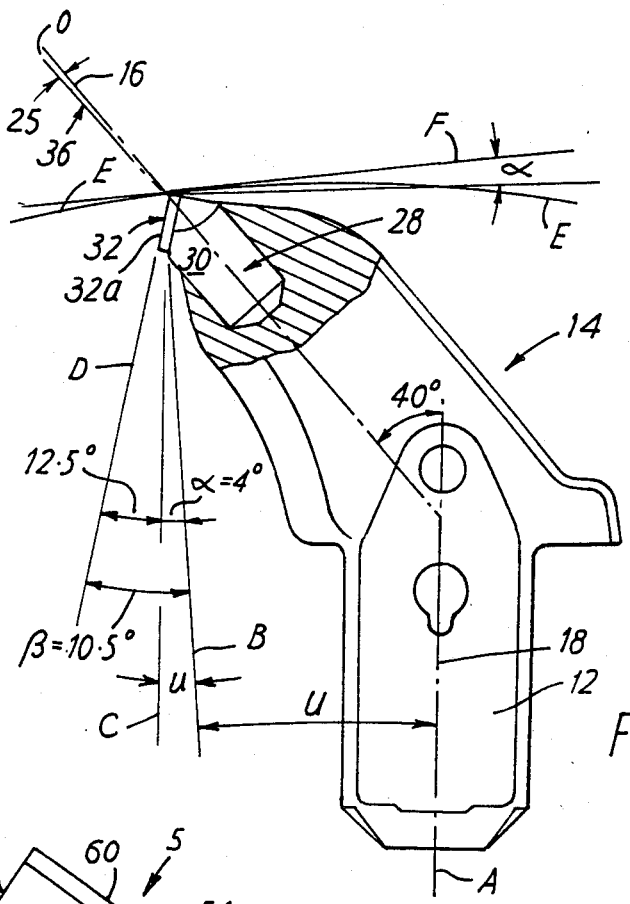
Figure 5:
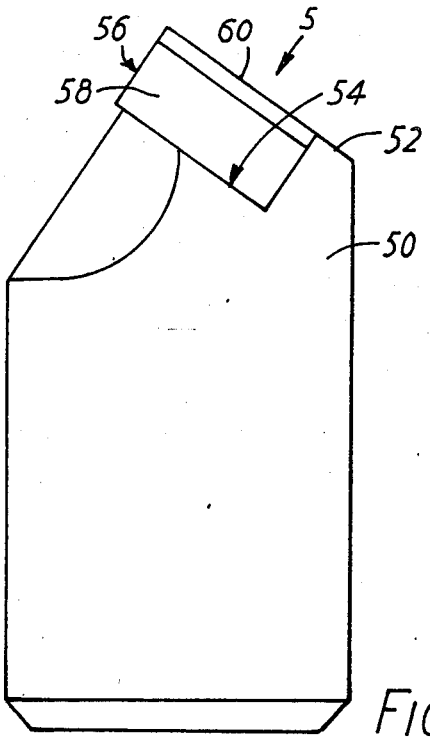
Figure 6:
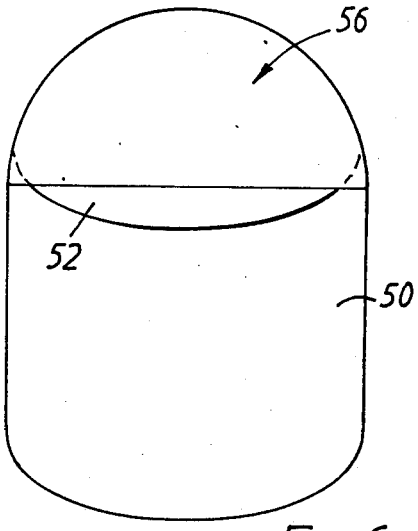
Figure 7:
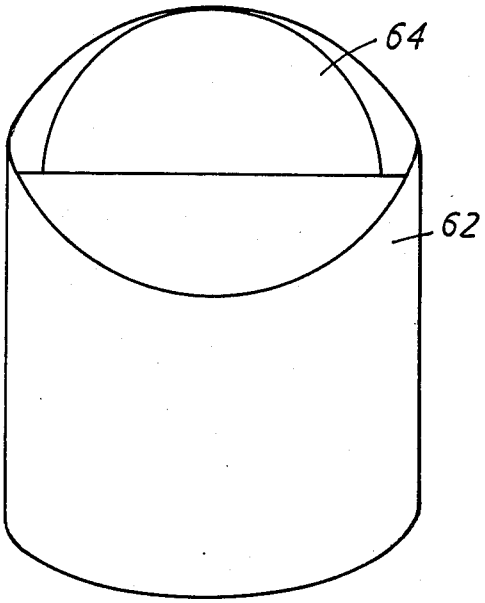
Figure 8:
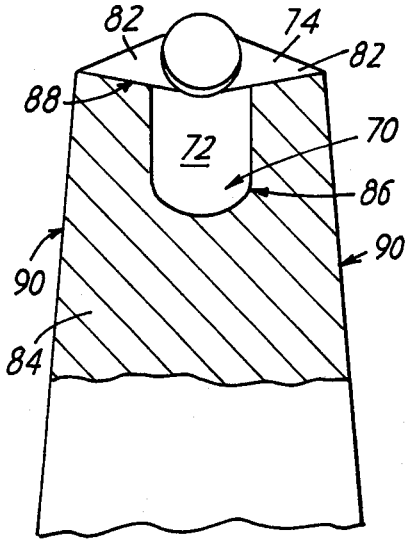
Figure 9:
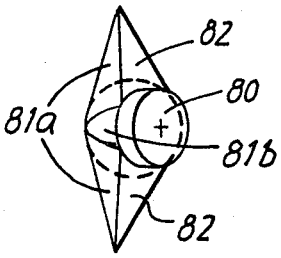
Figure 10:
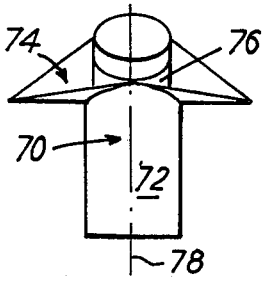
Figure 11:
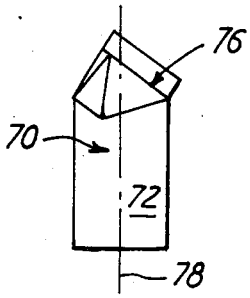
Figure 12:
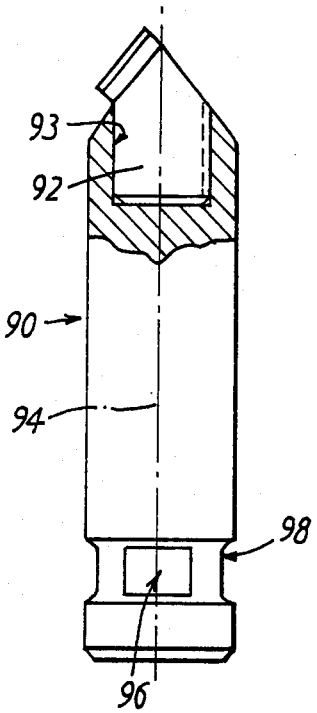
Figure 13:
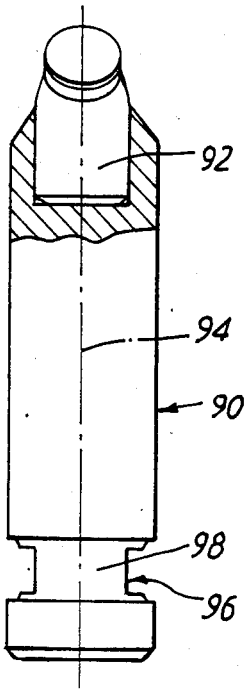
Figure 14:
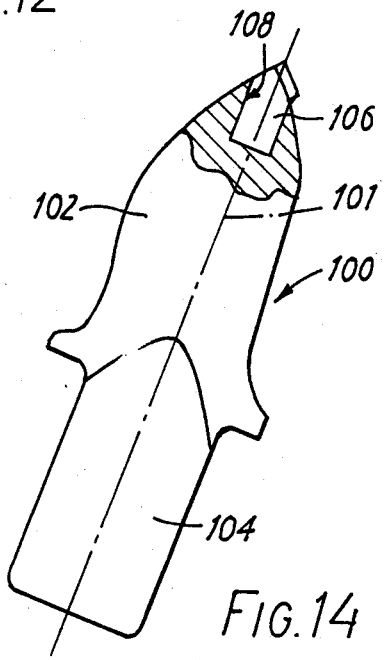

FIG. 2,

FIG. 4 is a diagrammatic sketch of the mining pick of FIG. 1 illustrating the various cutting angles, FIG. 5 is a side view of another stud of the invention, FIG. 6 a view of the stud of FIG. 5 taken in the direction of arrow 5, FIG. 7 is a view similar to FIG. 6 of a further stud of the invention, FIG. 8 is a detail section through another mining pick of the invention, FIGS. 9, 10 and 11 are plan, front and side views of the stud used in the mining pick of FIG. 8, FIGS. 12 and 13 are front and side views partially in section of a conical mining pick of the invention, and FIG. 14 is a forward attack pick of the invention.

Referring now to FIG. 1, there is shown a radial shank mining pick 10 of the invention intended for use in a coal cutting drum shearer and specifically for the arcuate cutting operations. The mining pick 10 comprises a hardened steel and has a rectangular shank 12 and a head 14.

The shank 12 is adapted to be inserted into a radial box or socket on the scroll of a nominal 1.8 m diameter wheel of a drum shearer (not shown). The head 14 is generally triangular in shape. The axis 16 of the head (i.e. the notional line central of the width of the pick joining the midpoint of the body 14 with the nose of the cutter which will be described below) is inclined to the axis 18 of the shank 12 at an angle of about 40°. The front edge 20 of the head 14 has inclined surfaces 22 to provide a sharpened face.

At the apex of the head 14 there is an inset pocket 24 in the form of a cylindrical blind bore, the axis of which lies on or close to the axis 16 of the head 14. A cutting insert or stud 28 is received in the pocket 24 and is brazed in position.

The stud 28 comprises a tungsten carbide body 30 carrying a cylindrical working PDC tip 40 comprising a polycrystalline diamond disc 32 of about 13 mm diameter which is formed on a low cylindrical tungsten carbide substrate 44 of the same diameter. The stud body 30 is cylindrical having a diameter of about 16 mm. A face 34 is formed on the stud body 30 inclined at 55° to the axis 36 of the stud body 30. The lower edge of the face 34 is about 23 mm from the flat bottom 38 of the stud body 30. The PDC 40 is brazed on to the face 34 in such a position that its axis 42 intersects the axis 36 of the stud body 30.

The tungsten carbide forming the substrate and the tungsten carbide forming the body 30, while not necessarily of the same composition, are both of impact resistant grade rather than wear resistant grade.

The upper end 46 of the stud body 30 is ground into the form of a segment of a cylinder which has a larger diameter than the PDC 40 and which has its axis parallel to the tip axis 42. The stud body 30 is received in the pocket 24 in such a way that the face **32*a* of the disc 32 lies in a plane that is normal to the longitudinal plane of symmetry of the mining pick 10 which will be in the direction of movement of the mining pick 10**.

A shallow longitudinally directed groove 48 is formed in the rear of the stud body 30 to permit brazing gasses to escape.

The stud 28 is a close fit in the pocket 24, the front edge of which is a cut-out. The depth of the pocket 24 is such that the upper edge of the polycrystalline diamond composite disc 32 projects a few millimeters above the upper surface of the head 14.

The geometry of the head 14 and the stud 28 is best shown in FIG. 4.

The face **32*a* of the disc 32 is inclined to the axis of the body 30 at an angle of 55° as mentioned above. The axis 18 of the shank 12 lies on a line A radial of the shearer drum scroll. The line B radial of the drum scroll passing through the nose of the disc 32 (i.e. the extreme outermost point of the disc 32) is at an offset angle $\alpha$ of 4° to the line C passing through the nose of the disc 32 and being parallel to the axis 18. The disc face 32*a* lies in a plane D to which the axis 18 of the shank 12 lies at an angle that is at about 12.5° and hence is inclined to the radial line B at an angle of 16.5°. In other words the disc 32 will engage the coal surface to be cut (indicated generally by the arc E described by the outer cutting edge of the disc 32) with a negative rake of about 16.5° at the plane F which is tangential to the arc E and hence at right angles to line B. This plane F indicates the instantaneous direction of translational movement of the disc 32. The head axis 16 is inclined to the plane F (the instantaneous direction of translational movement of the disc 32**) by an angle of 54° (i.e. 50° being the complement of 40°—the inclination of the head axis to the radial line A-plus 4°—the angular spacing between the line C and the radial line B) which constitutes the angle of attack of the pick.

The axis 36 of the stud body 30 is inclined to the head axis 16 by an angle o of 2.5.

Reference is now made to FIGS. 5 and 6 wherein is shown a cylindrical sintered tungsten carbide stud 50 having a diameter of about 13 mm. A face 52 inclined at 52.5° is formed at the upper end of the stud 50 and this face 52 has a stepped cut-out 54 formed therein. From the upper edge of the cut-out 54 the stud 50 has an arcuate surface the axis of which is inclined to the face 52 at 90°. Received in the cut-out 54 is a hemi-cylindrical working PDC tip 56. The tip 56 comprises a tungsten carbide substrate 58 on which is formed a polycrystalline diamond disc 60. The disc 60 is thus in the shape of a semi-circle. The diameter of the tip 56 is the same as that of the stud 50. The depth of the cut-out 54 is such that the face 60 will be flush with the face 52 or slightly above such face.

Referring now to FIG. 7, there is shown a tungsten carbide stud 62 which is generally similar to the stud 50 save that its diameter is about 16 mm and hence is larger than that of the hemicylindrical working tip 64.

In FIGS. 8 to 11 there is shown a stud 70 which is designed to protect the flanks of a mining pick. The stud 70, which comprises sintered tungsten carbide, has a cylindrical body 72 with an enlarged upper part 74. The upper part 74 extends from the front to the rear of the stud body 72 and its width is substantially the same as the width of the pick 84. A front face 76 inclined at 52.5° to the axis 78 of the body 72 is formed on the upper part 74. A PDC working tip 80 which is identical to the PDC 40 described above is mounted centrally on the face 76 and is brazed in position. The rear portion of the upper part 74 behind the front face 76 is formed with two substantially flat surfaces **81*a* connected by a segment 81*b* of a cylinder of larger diameter than the tip 80 and with its axis parallel to the axis of the tip 80**.

The working tip 80 will thus have a pair of pyramidal ears 82 on each side, which ears project outwardly from the body 72.

A mining pick 84 to receive the stud 70 (see FIG. 8) has a pocket 86 similar to pocket 24 described above but will in addition have side cut-outs 88 extending to its flanks 90 to receive the ears 82. The portion of the front face 76 of the stud 70 formed by the ears 82 will provide a front face for the mining pick 84 and will protect the flanks 90 from excessive wear.

In FIGS. 12 and 13 there is shown a conical pick 90 of the invention. A stud 92 (which is identical to the stud 28) is received in a pocket 93 at the apex of the pick 90. The axis of the stud 92 is coincident with the axis 94 of the pick 90. Flats 96 are machined into the base of the groove 98 formed in the pick 90 for the retaining clip (not shown) so that the latter prevents the conical pick rotating. The location of the flats 96 will be determined for each particular use of the conical pick 90.

In FIG. 14 there is shown a forward attack pick 100. This mining pick 100 has the axes 101 of its head 102 and shank 104 aligned. The mining pick 100 is used with a forward attack box or holder on the shearer drum scroll so that its angle of attack is the same as that of the pick 14 viz 54°.

The axes of the shank 104 and head 102 of the mining pick 100 are coincident. A stud 106 (which is identical to the stud 28) is received in a pocket 104 so that its axis is coincident or nearly coincident with the axis of the pick 100. The rake angle of the stud tip in the pick 100 will be the same as the PDC 40, viz 16.5°.

I have found that the direction of the resultant force on the polycrystalline diamond composite disc 32 in the mining pick 14 during the cutting operation will vary and will move from one position which I estimate will lie substantially parallel to the axis 42 of the stud 28 and will pass through the bottom 38 of the body 30 to another which I estimate will pass through the back of the stud 30 somewhat below the lower edge of the semi-cylindrical ground segment 46 of the body 30. Thus the resultant force on the stud 28 will be a compressive force.

In the embodiments illustrated in FIGS. 5 to 13, the effective cutting angle at the tip will be the same as described with reference to FIG. 4. Thus the resultant forces will pass through the stud in the same manner as described in relation to the first mentioned embodiment.

I have found that the tungsten carbide substrate 44 and the body 34 tend to wear away under the polycrystalline diamond composite face which has a self sharpening effect upon the composite face. We have further found that a considerably improved life span for the stud or insert 28 is obtained as compared to known cutting inserts on such mining picks. Indeed we have found that in practice (apart from the mining pick 84) the mining pick itself wears away before the stud 28 requires replacing. We have further found that no significant pressure increasing wear flats are formed on the stud.

The invention is not limited to the precise constructional details hereinbefore described and illustrated in the drawings. For example, the polycrystalline diamond composite cutting face need not be a complete or half disc but may comprise any segment of a circle.

The angle of the axis of the body to the PDC may vary between 45° and 65° as is required by the geometry of the machinery in which the picks are to be used and the shape of the picks themselves.

Where the mining pick is used in a wheel of a drum shearer which is smaller than that described above, the offset angle u between the lines radial of the wheel passing through the shank axis and the nose of the tip will vary, with a smaller wheel it will be more and with a larger wheel it will be less. I have further found that the angle o (between the axis of the body stud 30 and the head axis 16) will similarly vary by similar increments to those of the angle u.

The attack angle of the mining pick can be varied as is desired for engineering and other considerations but will normally be a positive angle of attack.

Furthermore where the mining pick is intended for use as a clearance ring mining pick for cutting clearance faces, a compound rake angle is sometimes required to make both the arcuate and the flat cuts. To this end, the stud is twisted about its axis. The angle through which the stud is twisted depends upon the inclination of the mining pick to the axis of the drum. When the pick axis is parallel to the drum axis, the amount of twist is 16.5°. The angle of twist decreases as the inclination of the pick to the drum axis approaches ninety degrees. Naturally the pocket of the mining pick will have to be changed to accomodate this changed disposition. This change will normally only be in milling out the front face of the pick to permit the working tip to project therethrough.

The stud may be used in other cutting devices as can the mining picks. For example the mining picks may be used on blind hole boring machine and continuous mining machines.

The stud may be fixed into the pocket by adhesive bonding.

The particular types of polycrystalline diamond composite used are those sold under the trade names "STRATAPAX" and "SYNDRILL". Other PDCs having similar characteristics if available may be used.

I claim:

1. A stud for use in a mining pick comprising (a) a tip consisting of a polycrystalline diamond composite and having a cutting face and (b) a body having two ends between which extends an axis, the body comprising a lower portion extending from one end of the body and a carrying surface at the other end of the body on which carrying surface the tip is mounted in which the carrying surface is inclined to the axis of the body by an angle of between 45° and 65°.

2. A stud as claimed in claim 1 in which the face of the tip is inclined to the axis of the body by an angle of 55°.

3. A stud as claimed in claim 1 in which the face of the tip is inclined to the axis of the body by an angle of 52.5°.

4. A stud as claimed in claim 1 in which the lower portion of the body is generally cylindrical in shape and has an enlargement at its said other end which enlargement provides extensions which extend outwardly from the said body on either side of the tip.

5. A stud as claimed in claim 4 in which the carrying surface is formed on the said enlargement.

6. A stud as claimed in claim 4 in which said extensions comprise a pair of pyramidal ears on each side of the body.

7. A mining pick comprising (a) a shank adapted to be received within a box of mining machine, the shank having a central axis, (b) a head extending from the shank, the head having an axis entending from substantially the intersection between the axis of the shank at the place where the head meets the shank to one extremity of the head, (c) a pocket having an axis in the head at its end remote from the shank and extending with the pocket axis substantially coincident with the head axis of the mining pick, and (d) a stud for use in the said mining pick comprising (i) a polycrystalline diamond composite tip and (ii) a cylindrical body having a carrying surface which is inclined to the axis of the body by an angle of between 45° and 65° and on which the tip is mounted, the body being received within the pocket.

8. A mining pick as claimed in claim 7 in which the axis of the pocket is inclined to the the said head axis by a very small angle.

9. A mining pick as claimed in claim 8 in which the said very small angle is of the order of 2.5°.

10. A mining pick as in claim 7 in which the body of the stud has a generally cylindrical main part and an enlargement at its upper surface portion that extends over a major proportion of the overall width of the body and provides extensions which extend outwardly from the said cylindrical body on either side of the tip and in which the pocket is provided with cut-outs on either side thereof to accommodate the said extensions.

11. A mining pick as claimed in claim 7 which is arranged to operate as a forward attack pick.

12. A mining pick as claimed in claim 7 in which the axis of the head is inclined to the axis of the shank.

13. A mining pick as claimed in claim 7 in which the axis of the head is aligned with the axis of the shank.

14. A mining pick as claimed in claim 13 in which at least a portion of the shank is non-circular in transverse section.

15. A pick comprising a shaft adapted to be received within a box of a mining machine and a head extending therefrom, the head having a head axis, the head also having a cylindrical pocket at its end remote from the shank, which pocket has an axis that extends substantially coincident with the head axis of the mining pick and received in the pocket a stud having a cylindrical body and a tip, the tip having a polycrystalline diamond composite cutting face in the shape of a segment of a circle, the cylindrical body having an axis and the cutting face being inclined to the axis of the body by an angle of between 45° and 65°.

* * * * *